United States Patent [19]

Lo Guidici

[11] Patent Number: 5,070,661

[45] Date of Patent: Dec. 10, 1991

[54] PREFABRICATED DWELLING UNIT

[76] Inventor: Vincent Lo Guidici, 173 Redgrave Ave., Staten Island, N.Y. 10306

[21] Appl. No.: 409,829

[22] Filed: Sep. 20, 1989

[51] Int. Cl.[5] ..... E04B 5/58

[52] U.S. Cl. ..... 51/79.1; 52/221; 52/234

[58] Field of Search ..... 52/79.1, 69, 221, 173, 52/234

[56] References Cited

U.S. PATENT DOCUMENTS

| | | | |
|---|---|---|---|
| 375,998 | 1/1888 | Hodges | 105/409 |
| 2,363,259 | 11/1944 | Penton | 52/234 |
| 3,097,877 | 7/1963 | Erlandsen | 296/28 |
| 3,680,273 | 8/1972 | Bigelow | 52/173 |
| 3,768,221 | 10/1973 | Fuller | 52/741 |
| 3,806,147 | 4/1974 | Hanson | 296/168 |
| 4,361,189 | 11/1982 | Adams | 169/62 |
| 4,400,921 | 8/1983 | Frenkel | 52/814 |
| 4,546,969 | 10/1985 | Wilson | 296/181 |
| 4,570,396 | 2/1986 | Struben | 52/90 |
| 4,679,365 | 7/1987 | Herring | 52/69 |

FOREIGN PATENT DOCUMENTS

| | | | |
|---|---|---|---|
| 1403107 | 5/1965 | France | 296/2 |

*Primary Examiner*—James L. Ridgill, Jr.
*Attorney, Agent, or Firm*—Bauer & Schaffer

[57] ABSTRACT

There is disclosed a prefabricated dwelling capable of being employed on a single dwelling unit or in cooperative relationship with one or more like dwelling units, the dwelling unit having a body member provided with a wooden floor, a pair of corrugated side walls attached to the floor around the periphery thereof and enclosing the area above the floor, a cover member attached to the side walls opposite the floor and a door at level one and at least one window located in the side walls, the corrugations of the side walls facing toward the interior of the dwelling unit and forming supporting and strengthening studs therefor. The dwelling unit may also be provided with electrical connections, cabinet units, a cooking unit and kitchen and bathroom plumbing units and associated fuel lines, water lines and sewer lines, water taps, smoke alarms and a sprinkler system. A plurality of the units can be stacked in a vertical disposition one on top of another and provided with an external stairway for access to each unit and the units may be disposed in a horizontal, staggered relationship, abutting each other.

8 Claims, 3 Drawing Sheets

Fig. 6
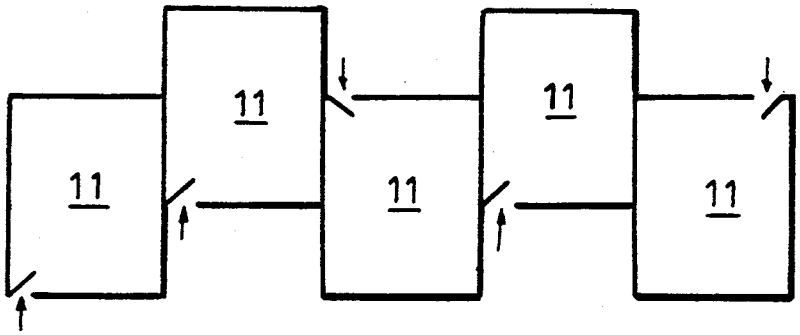
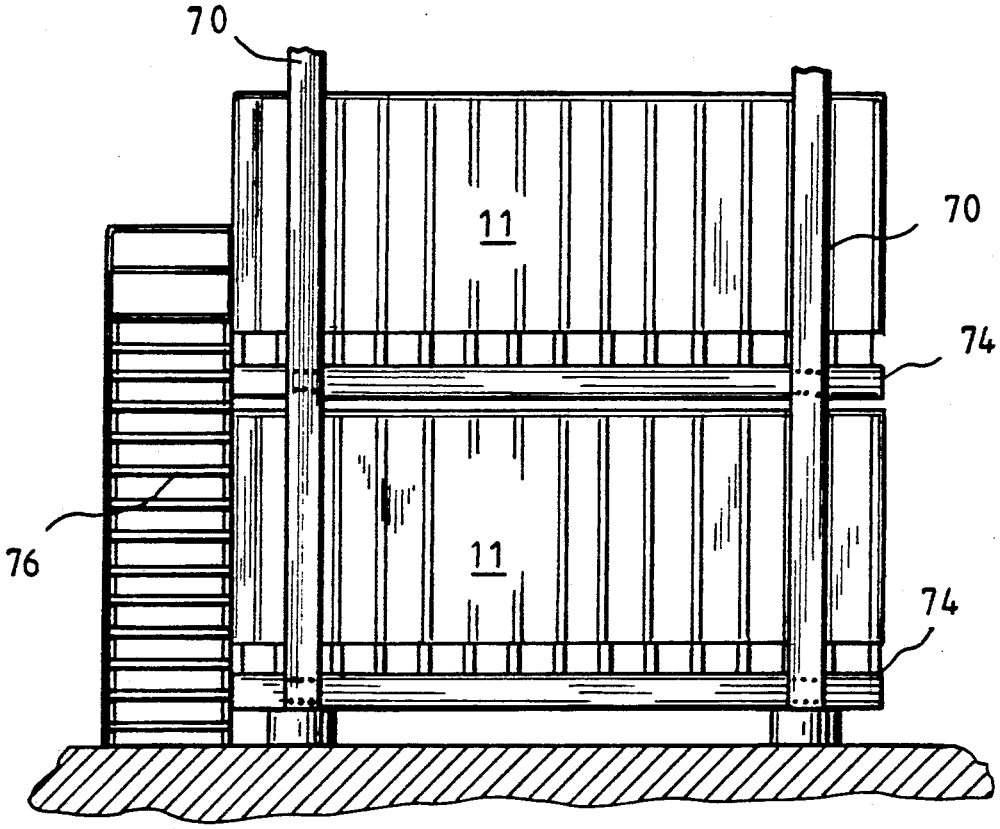
Fig. 7

PREFABRICATED DWELLING UNIT

The present invention relates to the construction of a dwelling unit and more particularly, to a prefabricated dwelling unit useful as a prefabricated stable.

BACKGROUND OF THE INVENTION

Prefabricated shelter units, such as prefabricated buildings for use as shelters of various types, such as stables, barns and houses, for animal or human use are well known, as well as prefabricated construction for warehouses, sheds, offices and the like.

While known structures of these types have generally proven satisfactory for their intended uses, there still exists a need for the provision of prefabricated structures of the type generally described above which are particularly suited for human habitation and which are simple in design, but which exhibit good strength and a substantial reduction in cost. The present invention fulfills such a need.

The initial purpose of the present invention is to provide an inexpensive, easily constructed and easily installed dwelling unit for human use. Therefore, the present disclosure will, for convenience and clarity, relate to and disclose a preferred form of sturcture for this purpose. It will nevertheless be appreciated, that the structure with very minor modification or change, can be used and adapted as a shelter for animals, or as a shelter for any other known or even unknown use. Consequently, the present invention should not be limited inconsequentially as a result of the foregoing disclosure.

BRIEF STATEMENT OF THE INVENTION

In accordance with the present invention, there is provided a prefabricated dwelling unit capable of being employed as a single dwelling unit or in a cooperative relationship with at least one other like dwelling unit, the dwelling unit comprising a unitary body member having a floor, a plurality of integrally connected corrugated side walls, and a cover member of ceiling. The floor may be covered by a wooden or similar platform and the walls covered also by panelling or the like and at least one door and at least one window is located in the side walls. The body is also divided by one or more vertical walls extending between the sides which form two or more rooms therein. The corrugated side walls, face toward the interior of the unit forming supporting and strengthening studs thereon.

As employed in an assembly of a plurality of dwelling units, such as those described above, the units are disposed in a horizontal, staggered assembly abutting each other or stacked one on top of another in stacks preferably four units high, although as little as two units and more than four may be so disposed and when vertically stacked, are provided with a stairway.

Preferably the unitary body is integrally preformed of corrugated metal, such as steel, aluminum, plastic or the like, much in the manner of a corrugated cargo container. Such structures are easily transportable, very strong and durable and using modern technology, quite inexpensive to make and install.

THE DRAWINGS

In order to describe the prefabricated dwelling unit of the present invention more fully, reference is directed to the accompanying drawings which are to be taken in conjunction with the following description and in which drawings:

FIG. 6 is a plan view of plurality of dwelling units such as illustrated in FIG. 1 showing the units in a horizontal disposition or assembly abutting one another; and FIG. 7 is a view in perspective of a plurality of dwelling units such as illustrated in FIG. 1 showing the units in a stacked relationship one on top of another and provided with a stairway for accessing each level in the stack.

DESCRIPTION OF THE PREFERRED EMBODIMENTS

Figure 1:
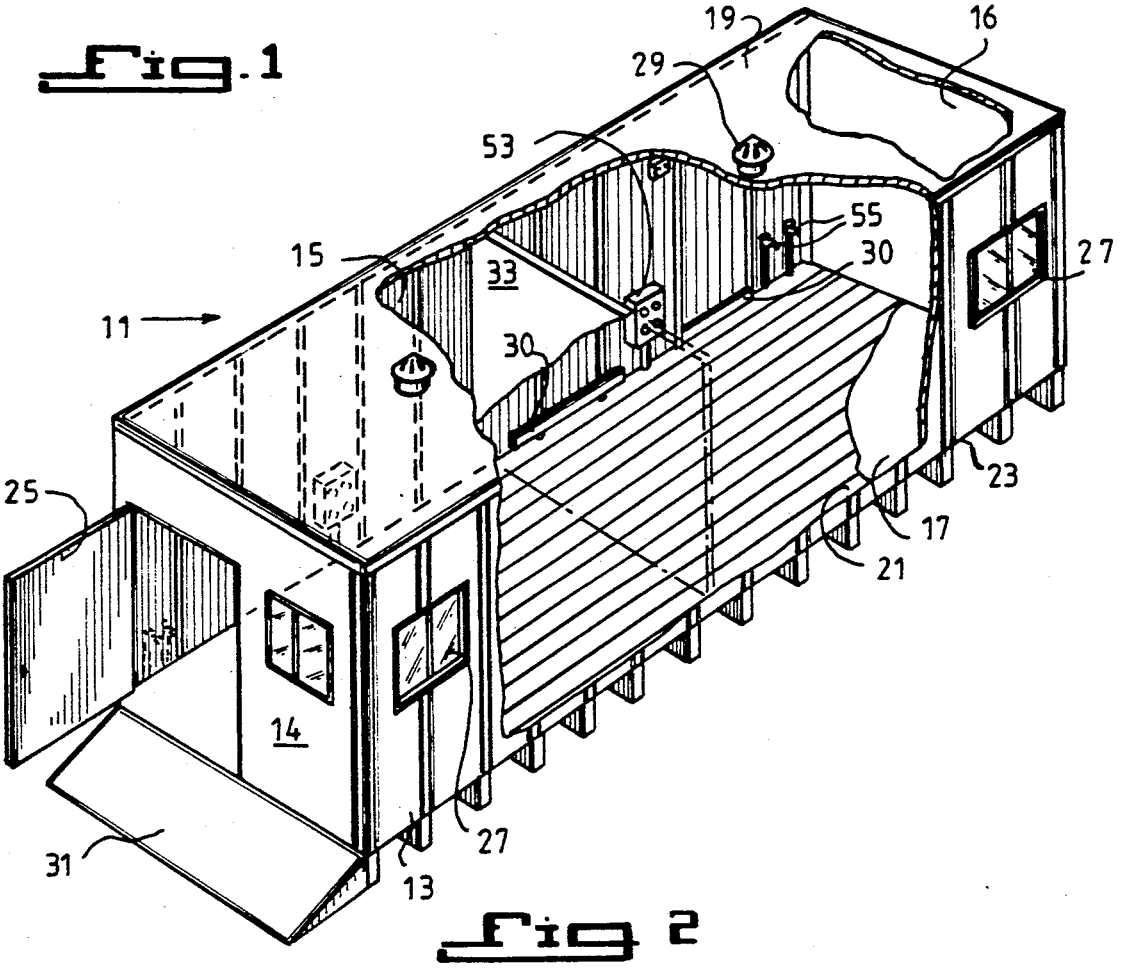
FIG. 1 is a view in perspective and partially in section of a perfabricated dwelling unit according to the invention which is useful for human habitation.

Referring now to FIG. 1, the prefabricated dwelling unit 11 in accordance with the present invention comprises an elongated body member, having integrally connected side walls 13, 15, end walls 14 and 16 and a bottom platform 17 and ceiling 19. A wooden floor 21 is placed over the platform 17 in a conventional manner, such as by a plurality of bolts, nails, clips or other fastening means (not shown).

The side walls 13, 14, 15 and 16, platform 17 and the ceiling member 19 are made of relatively light gauge but rigid corrugated steel sheets. Rigid plastic sheets, such as molded nylon, polyethylene, polyurethane and the like may also be corrugated and used. The corrugations 23 are spaced approximately one foot apart, thus forming supporting and strengthening studs as well as room for plumbing, electrical, heating and other duct work and conduits to be placed. In general, the construction of corrugated sheets for use as walls and platform is known, for example, in connection with the construction of large shipping containers.

The body member 11 is provided with a door 25 which is located in wall 14 and is fixed by means of hinges to the unit wall. Suitable closure means, hasps, locks, etc., are employed so that the doors can be opened and closed in any variety of combination. A similar door may be placed at the opposite end 16 or either of the side walls 13 and 15. Windows 27 are spaced about the unit in the walls 13 and 15 at predetermined locations and air conditioning and heating ventilators 29 in the ceiling. Radiant base board heaters 30 are mounted along the walls 13 and 15.

To provide convenient access and egress to and from the unit, suitable means, such as ramp 31 is removably attached to the floor of the body member at the location of the door to avoid any deep step. The ramp may be made of concrete, metal or wood as desired. The ramp may, of course, be replaced by one or more steps as needed.

The unit 11, in accordance with the present invention is divided into a plurality of compartments by means of partitions, bulkheads or separating supporting walls which are disposed within the confines of the unit between the walls of the body member. For clarity only, one bulkhead or separating wall is shown in FIG. 1, the interior arrangements of the dwelling unit 11 are set out more fully in FIGS. 3 to 6.

Figure 3:
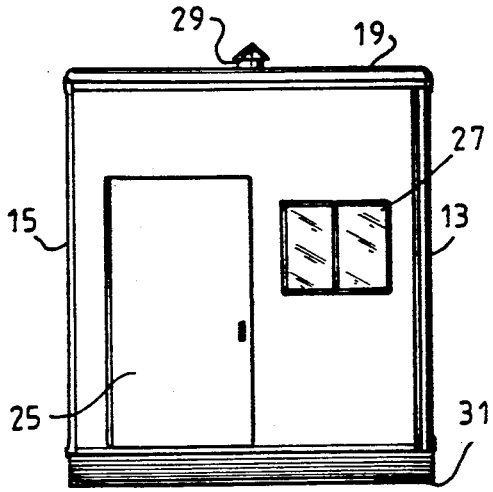
FIG. 3 is an end view in elevation of the dwelling unit illustrated in FIG. 1.
Figure 4:
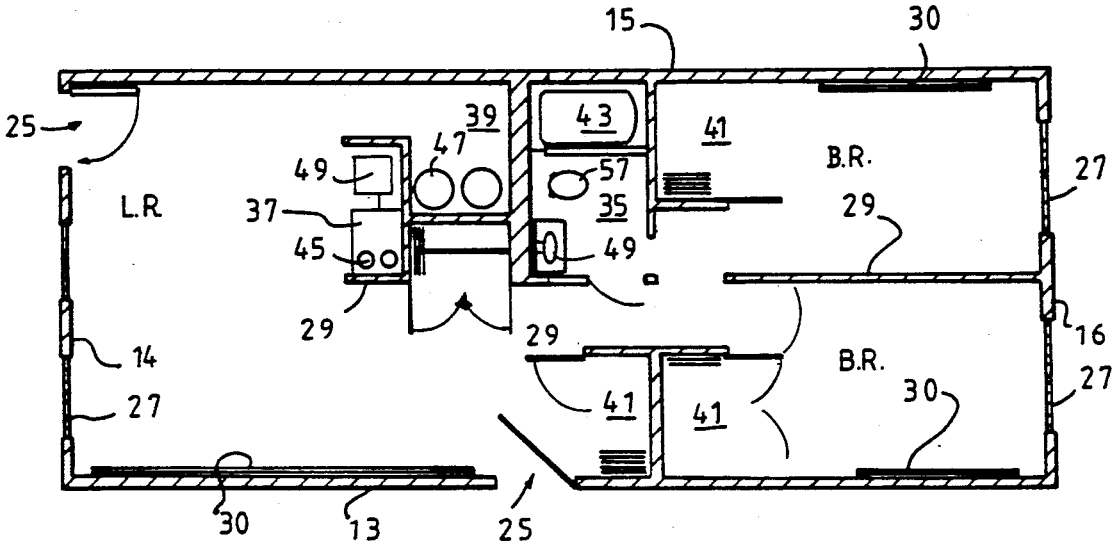
FIG. 4 is plan view of the dwelling unit illustrated in FIG. 1 with the cover or ceiling removed, showing one typical disposition of the supporting walls which divide the unit into compartments or rooms and the disposition of the kitchen and bathroom and utility room.

As seen in FIG. 3, a plurality of such partitions 33 are arranged by design to form such compartments as bedrooms, living rooms, kitchens, bathrooms, closets and utility rooms with a typical bathroom 35, kitchen 37, utility room 39 and closets 41 being shown. The usual hardware for such installations such as tub 43, cooking unit 45, heating unit 47, sinks 49 and commode 51. Morover, several windows 27 may also be disposed in the walls of the unit. One or more vents 29, are preferably disposed in the ceiling member 19 and electrical radiants heading systems 30 are mounted along the walls between adjacent corrugations. A sprinkler system may also be located on the interior surface of the ceiling as shown in broken lines in for fire safety purposes. Sprinkler system is attached to an appropriate reservoir or supply of water (not shown). Generally these items are easily received in an appropriate sectional recess of the corrugation so as to be out of the way of the unit occupant.

As previously mentioned, the prefabricated dwelling unit is particularly useful as a prefabricated human habitation which may be transported to a site for use as such and in such a case, the unit may be provided with electrical outlet means 53 connected to an appropriate supply of electricity. As stated above, the corrugation of the side walls are spaced approximately one foot apart and the electrical means 53 is located between consecutive corrugations or studs. In like manner, full lines 55, water lines and sewer lines may also be disposed between a pair of consecutive corrugations and connected to appropriate sources (not shown) in any convenient manner. In addition, smoke alarms, such as smoke alarms 45 may also be disposed between consecutive corrugations in the interior of the container.

Figure 2:
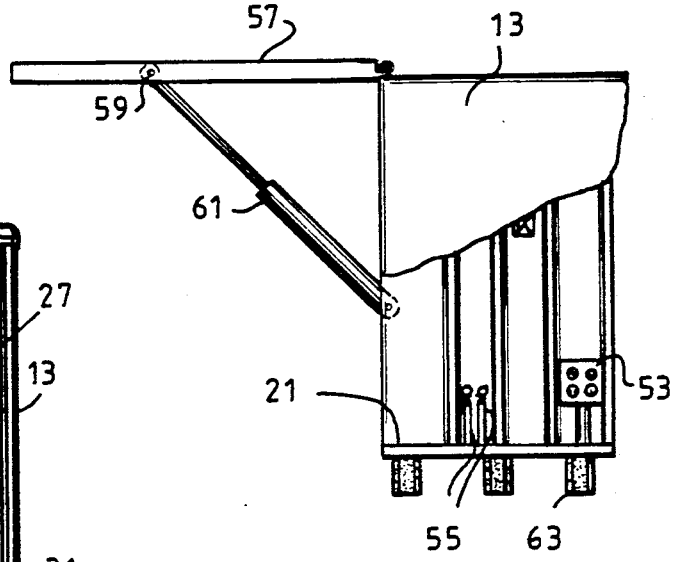
FIG. 2 is a partial elevational view, partially in section, of the unit illustrated in FIG. 1.

Turning now to FIG. 2, the structure can be modified by providing flap or awning 57 at one end in lieu of wall or door. The flap is secured by a hinge arrangement 59 attached to ceiling 19 and which may be opened and closed by means of a pneumatic piston and cylinder arrangement 61. In an open position, as shown in FIG. 1, door flap 57 also provides protection against the sun or precipitation, such as rain or snow and provides a large access opening for the introduction of items such as furniture into the unit.

The prefabricated dwelling unit described above, can be further finished by providing exterior and interior covering walls. These exterior walls may be made from light gauge metal or any other desirable material such as plastic sheeting and the like. These panels serve to enclose the corrugations from view and if desired, may be provided with decorative material on their exterior surfaces. The structure, while highly mobile, is preferably laid upon a supporting arrangement of footings, such as concrete blocks 63, ribs or the like, as seen in FIG. 2.

Figure 5:
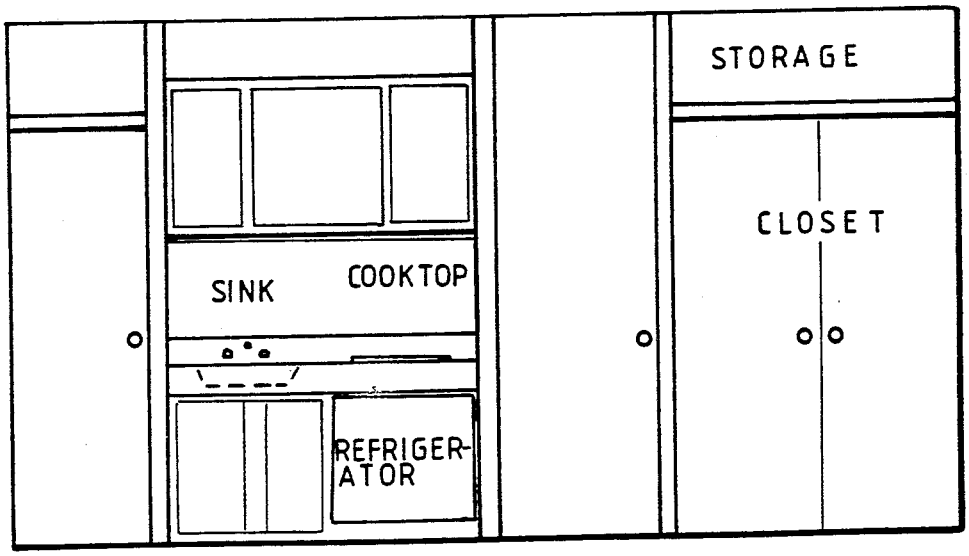
FIG. 5 is an elevational view of the interior of a model showing a modified kitchen and closet arrangement.

FIG. 5 further illustrates the manner in which the interior can be finished with a refrigerator, sink, stove top, closets, pantry and storage areas. FIG. 5 is purely illustrative and the design of the dwelling unit can follow the varible dictates of interior decorators and the inhabitants.

A plurality of units 11 can be arranged in a horizontal, staggered relationship as shown in FIG. 6. On the other hand, as shown in FIG. 7, the units 11 may also be stacked vertically one on the other. Preferably a rigid structural frame 70 is built up from the ground 72 and the units are individually supported on horizontal beams 74. The stacked assembly is provided with an external stairway 76 to provide access and egress to and from the individual within the stack. Variations in the design of the stack or in the horizontal disposition of a plurality of units 11 can be made by any designer or architect without any difficulty.

To present invention provides many advantages. For example, the dwelling unit of the present invention can be made in a relatively simple manner with readily available materials and the resulting product is strong yet relatively light in weight. Moreover, other advantages of the present invention will be readily apparent to those skilled in the art.

Accordingly, it is to be understood that the present invention is not to be limited to the described embodiments thereof, except as defined in the appended claims.

What is claimed is:

1. A prefabricated dwelling unit capable of being employed as a single housing having a floor, a plurality of opposed corrugated side and end walls attached to said floor around the periphery thereof and enclosing the area above said floor, the corrugations of said side walls facing toward the interior of said dwelling unit and forming supporting and strengthening studs therefor, a cover member attached to said side walls opposite said floor, and at least one door and at least one window located in said side walls, a plurality of corrugated supporting walls disposed in the interior of the housing dividing said housing into a plurality of compartments, some of said supporting walls extending from a side wall toward an opposite side wall, but stopping short thereof and some of said supporting walls extending between opposing end walls, but stopping short of said opposing end walls, to dividing said housing into a plurality of living rooms interconnecting with each other, electrical means located on an interior surface of at least one side wall between a pair of consecutive studs formed by the corrugations of said side wall, cabinet units, a cooking unit and kitchen and bathroom plumbing units located along at least one side wall and including associated fuel lines, water lines and sewer lines located on the interior surface of a least one side wall between pairs of consecutive studs formed by the corrugations of said side wall.

2. A plurality of dwelling units according to claim 1 disposed in a vertical assembly one on another and including an exterior stairway located along the exterior of at least one side wall, whereby access is provided to the door of each unit.

3. A plurality of prefabricated dwelling units according to claim 1 disposed in a horizontal, staggered assembly and abutting each other.

4. A prefabricated dwelling unit according to claim 1 including at least one vent disposed on the exterior surface of the cover member.

5. A prefabricated dwelling unit according to claim 1 including at least one smoke alarm disposed on the interior surface of the cover member.

6. A prefabricated dwelling unit according to claim 1 including a sprinkler system disposed on the interior surface of the cover member.

7. A prefabricated dwelling unit according to claim 1 wherein the side walls are made from corrugated steel sheets.

8. A prefabricated dwelling unit according to claim 1 wherein the side walls are made from corrugated plastic sheets.

* * * * *